US010415892B2

(12) United States Patent
Kanagala et al.

(10) Patent No.: US 10,415,892 B2
(45) Date of Patent: Sep. 17, 2019

(54) HEAT EXCHANGE TUBES AND TUBE ASSEMBLY CONFIGURATIONS

(71) Applicant: Rheem Manufacturing Company, Atlanta, GA (US)

(72) Inventors: Hari Krishna Kanagala, Fort Smith, AR (US); Ken Frederick, Fort Smith, AR (US); Darrell Binz, Charleston, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 15/849,416

(22) Filed: Dec. 20, 2017

(65) Prior Publication Data

US 2019/0186847 A1 Jun. 20, 2019

(51) Int. Cl.
*F28F 1/20* (2006.01)
*F28F 1/00* (2006.01)
*F28F 13/08* (2006.01)

(52) U.S. Cl.
CPC ..... *F28F 1/006* (2013.01); *F28F 13/08* (2013.01)

(58) Field of Classification Search
CPC .... F28F 1/30; F28F 1/006; F28F 13/08; F28F 1/40; F28F 13/04; F28D 1/0477; B21C 37/20
USPC ..... 165/181
See application file for complete search history.

(56) References Cited

U.S. PATENT DOCUMENTS

| | | | | |
|---|---|---|---|---|
| 4,715,436 | A * | 12/1987 | Takahashi | B21C 37/20 165/110 |
| 5,222,552 | A | 6/1993 | Schuchert | |
| 9,476,656 | B2 | 10/2016 | Anwar | |
| 2002/0040777 | A1 | 4/2002 | Tomlinson et al. | |
| 2004/0079522 | A1 | 4/2004 | Paulman et al. | |
| 2004/0104015 | A1 | 6/2004 | O'Donnell et al. | |
| 2007/0089873 | A1 | 4/2007 | Beste et al. | |
| 2015/0122471 | A1* | 5/2015 | Lee | F28F 1/30 165/181 |
| 2018/0031274 | A1* | 2/2018 | Wilson | F28D 1/0477 |

FOREIGN PATENT DOCUMENTS

| | | | | |
|---|---|---|---|---|
| EP | 0798529 | A1 * | 10/1997 | F28F 1/40 |

OTHER PUBLICATIONS

International search report for PCT/US2018/064110, dated Mar. 7, 2019.

* cited by examiner

*Primary Examiner* — Davis D Hwu
(74) *Attorney, Agent, or Firm* — King & Spalding LLP

(57) ABSTRACT

A heat exchange tube for an HVAC system can include at least one reduced diameter section with an integral flattened ridge. The flow of combustion gases through the heat exchanger tubes may be partially constricted inside the reduced diameter sections. When installed in an HVAC system the integral flattened ridges may be angled to intercept the flow of air outside the heat exchanger tubes.

19 Claims, 4 Drawing Sheets

HEAT EXCHANGE TUBES AND TUBE ASSEMBLY CONFIGURATIONS

TECHNICAL FIELD

Embodiments described herein relate generally to heat exchange (HX) tubes, and more particularly to HX tubes comprising at least one reduced diameter section having an integral flattened ridge, and to tube assemblies for heat exchangers that comprise such tubes.

BACKGROUND

Heat exchangers, such as ones used in heating, ventilation, and air conditioning (HVAC) systems, and other similar devices (generally called heat exchangers) control or alter thermal properties of one or more fluids, such as air. In some cases, tubes (also called heat exchange tubes or HX tubes) disposed within these devices are used to transfer through the HX tubes a working fluid that is at a different thermal condition from that of fluid outside the HX tubes, thereby altering the thermal properties of the working fluid within the HX tubes and the fluid, such as air, passing over the outside of the HX tubes. The temperature of the working fluid and the fluid passing over the outside of the HX tubes can increase or decrease, depending on how the device is configured. The working fluid and the fluid outside the HX tubes do not mix at any part of the heat exchanger. There have been many approaches to increase the thermal efficiency of the HX tube that in turn may increase the efficiency of the device, since the overall thermal efficiency of the device depends on both the working fluid and fluid outside the HX tubes.

One approach to increase thermal efficiency of the HX tube is to enhance the turbulence of working fluid inside the HX tube by adding baffles or turbulators inside the HX tube. In another approach, the HX tube has multiple dimple like deformations on the HX tube surface to increase velocity of the working fluid at the deformations, thus increasing the turbulence.

All the above approaches are aimed at enhancing the thermal efficiency of the HX tubes alone, but not the overall thermal efficiency of the heat exchanger which also depends on the interaction between the HX tubes and outside fluid. In addition to the overall thermal efficiency of the heat exchanger device, any improvement in the pressure drop of the outside fluid can generate considerable energy and cost savings.

SUMMARY

In general, in one aspect, the disclosure relates to a tube for a thermal transfer device, such as a heat exchanger within an HVAC. A general embodiment of the disclosure is a heat exchange tube comprising at least one reduced diameter section comprising an integral flattened ridge which extends outwardly from the reduced diameter section. In some embodiments the heat exchange tube additionally comprises an upper straight section, a lower straight section, and a bent section connecting the upper straight section with the lower straight section, wherein the upper straight section and the lower straight section are about parallel to each other. The at least one reduced diameter section can be located on only one of the straight sections or on both of the straight sections. In other embodiments, the heat exchange tube is straight. In some embodiments, the heat exchange tube comprises between 2-8 reduced diameter sections, such as 2, 3, 4, 5, 6, 7, or 8 reduced diameter sections. In specific embodiments, a length of one of the reduced diameter sections is different from a length of at least one other reduced diameter section. In some embodiments the at least one reduced diameter section has a diameter that is about less than two thirds or less than half a largest diameter of the heat exchange tube. In some embodiments, the integral flattened ridge extends past the largest diameter of the heat exchange tube, for example by extending past the largest diameter by at least 10 or 20 percent of the largest diameter of the heat exchange tube. In specific embodiments, a working fluid is able to move within the flattened ridge. In additional embodiments, the integral flattened ridge extends at an angle of between −90 degrees and 90 degrees from a direction of air flow over the heat exchange tube.

Another general embodiment of the disclosure is a furnace comprising a heat exchanger comprising a plurality of heat exchange tubes, wherein the plurality of heat exchange tubes are configured to receive a heated working fluid from a burner assembly and wherein each heat exchange tube comprises a reduced diameter section comprising an integral flattened ridge which extends outwardly from the reduced diameter section, an exhaust configured to receive the working fluid from the plurality of heat exchange tubes, and a circulation blower fan configured to move air over an outside of the plurality of heat exchange tubes and into a supply duct. In some embodiments, the integral flattened ridge extends at an angle of between −90 degrees and 90 degrees from a direction of air flow through the heat exchanger. In specific embodiments, the heat exchanger comprises between 2-20 heat exchange tubes. In some embodiments, each heat exchange tube comprises between 2-8 reduced diameter sections with integral flattened ridges. The integral flattened ridge can extend at an angle of between −90 to −60 or 60 to 90 degrees from a direction of air flow through the heat exchanger. In specific embodiments, each heat exchange tube additionally comprises an upper straight section, a lower straight section, and a bent section connecting the upper straight section with the lower straight section, wherein the upper straight section and the lower straight section are about parallel to each other. In other embodiments, the heat exchange tubes are straight. In some embodiments, the upper straight section and the lower straight section define a reference plane that forms an angle between −90° to 90° from a direction of air flow through the heat exchanger.

These and other aspects, objects, features, and embodiments will be apparent from the following description and the appended claims.

BRIEF DESCRIPTION OF THE DRAWINGS

The drawings illustrate only example embodiments of HX tubes and tube assembly configurations within systems and are therefore not to be considered limiting in scope, as HX tubes and tube assembly configurations may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
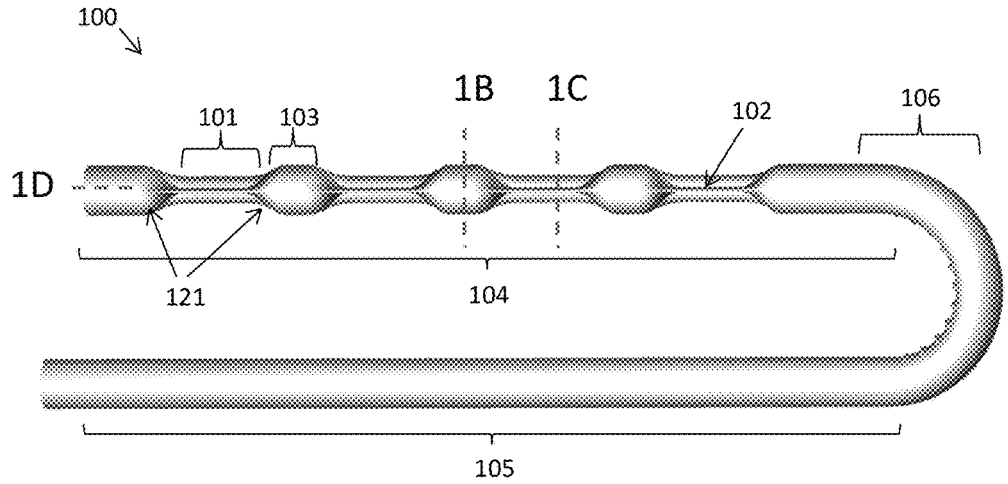
FIG. 1A is an example heat exchange tube.

The example embodiments discussed herein are directed to systems, methods, and devices for HX tubes and tube assembly configurations within a heat exchanger. Example embodiments can be directed to any of a number of thermal transfer devices, including but not limited to heat exchangers used in an HVAC system.

Example embodiments can be pre-fabricated or specifically generated (e.g., by shaping a malleable body) for a particular heat exchanger and/or environment. Example embodiments can have standard or customized features (e.g., shape, size, features on the inner surface, pattern, configuration). Therefore, the example embodiments described herein should not be considered limited to creation or assembly at any particular location and/or by any particular person.

The HX tubes (or components thereof) described herein can be made of one or more of a number of suitable materials and/or can be configured in any of a number of ways to allow the HX tubes (or devices (e.g., HVAC systems) in which the HX tubes are disposed) to meet certain standards and/or regulations while also maintaining reliability of the HX tubes, regardless of the one or more conditions under which the HX tubes can be exposed. Examples of such materials can include, but are not limited to, alloys of aluminum, stainless steel, or titanium.

As discussed above, heat exchangers can be subject to complying with one or more of a number of standards, codes, regulations, and/or other requirements established and maintained by one or more entities. Examples of such entities can include, but are not limited to, the American Society of Mechanical Engineers (ASME), the Tubular Exchanger Manufacturers Association (TEMA), the American Society of Heating, Refrigeration and Air Conditioning Engineers (ASHRAE), Underwriters' Laboratories (UL), the National Electric Code (NEC), the Institute of Electrical and Electronics Engineers (IEEE), and the National Fire Protection Association (NFPA). Example HX tubes allow a heat exchanger to continue complying with such standards, codes, regulations, and/or other requirements. In other words, example HX tubes, when used in a heat exchanger, do not compromise compliance of the heat exchanger with any applicable codes and/or standards.

Any example HX tubes, or portions thereof, described herein can be made from a single piece (e.g., as from a mold, die cast, 3-D printing process, extrusion process, stamping process, crimping process, and/or other prototype methods). In addition, or in the alternative, example HX tubes (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably. In some embodiments, a rod is inserted into the tube against one inner side of the tube and then the tube is crimped, conforming the reduced diameter section to the shape of the rod. The rod could be circular, square or oval, for example. One embodiment of the disclosure is a method of making a heat exchange tube comprising receiving a heat exchange tube; inserting a solid rod into the tube against one side; clamping or crimping a portion of the heat exchange tube together such that a reduced diameter section comprising an integral flattened ridge which extends outwardly from the reduced diameter section is formed.

As described herein, a user can be any person that interacts with HX tubes or heat exchangers in general. Examples of a user may include, but are not limited to, an engineer, a maintenance technician, a mechanic, an employee, a visitor, an operator, a consultant, a contractor, and a manufacturer's representative.

As used herein, a "coupling feature" can couple, secure, fasten, abut, and/or perform other functions aside from merely coupling. A coupling feature as described herein can allow one or more components of a HX tube to become coupled, directly or indirectly, to another portion (e.g., an inner surface) of the HX tube. A coupling feature can include, but is not limited to, a swage, a snap, a clamp, a portion of a hinge, an aperture, a recessed area, a protrusion, a slot, a spring clip, a tab, a detent, a compression fitting, and mating threads. One portion of an example HX tube can be coupled to a component of a heat exchanger and/or another portion of the HX tube by the direct use of one or more coupling features.

In addition, or in the alternative, a portion of an example HX tube can be coupled to another component of a heat exchanger and/or another portion of the HX tube using one or more independent devices that interact with one or more coupling features disposed on a component of the HX tube. Examples of such devices can include, but are not limited to, a weld, a pin, a hinge, a fastening device (e.g., a bolt, a screw, a rivet), epoxy, adhesive, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. For any figure shown and described herein, one or more of the components may be omitted, added, repeated, and/or substituted. Accordingly, embodiments shown in a particular figure should not be considered limited to the specific arrangements of components shown in such figure.

Example embodiments of HX tubes will be described more fully hereinafter with reference to the accompanying drawings, in which example embodiments of HX tubes are shown. HX tubes may, however, be embodied in many different forms and should not be construed as limited to the example embodiments set forth herein. Rather, these example embodiments are provided so that this disclosure will be thorough and complete, and will fully convey the scope of HX tubes to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "above", "lower", and "upper" are used merely to distinguish one component (or part of a component or state of a component) from another. Such terms are not meant to denote a preference or a particular orientation unless specified, and are not meant to limit embodiments of HX tubes. Unless otherwise noted, "diameter" refers to the outer diameter of a HX tube. In the following detailed description of the example embodiments, numerous specific details are set forth in order to provide a more thorough understanding of the disclosure. However, it will be apparent to one of ordinary skill in the art that the invention may be practiced without these specific details. In other instances, well-known features have not been described in detail to avoid unnecessarily complicating the description.

FIG. 1A illustrates one example of a HX tube 100 of the disclosure for use in a HVAC system. The HX tube 100 has four reduced diameter sections, each reduced diameter section 101 comprising an integral flattened ridge 102 which extends outwardly from the reduced diameter section 101. A standard diameter section 103 can be found between each reduced diameter section 101. In some embodiments, sections found between the reduced diameter sections have smaller diameters than the standard diameter, but larger diameters than the reduced diameter sections. This can come about from placing two reduced diameter sections close together such that the area between them is still slightly deformed from standard. The HX tube 100 is bent 180 degrees such that it comprises an upper straight section 104 (also known as a first pass), a lower straight section 105 (also known as a second pass), and a bent section 106 between the two straight sections (104 and 105) with a 180 degree bend.

Figure 1C:
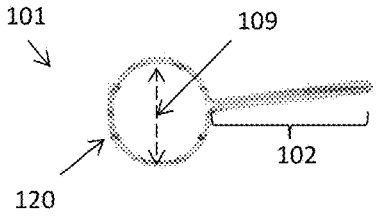
FIG. 1C is a cross section view of FIG. 1A taken along line 1C from FIG. 1A.
Figure 1B:
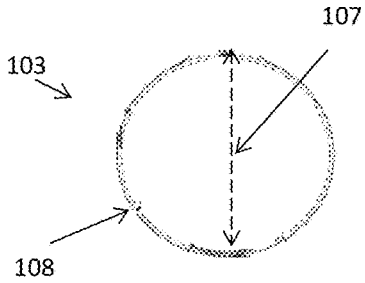
FIG. 1B is a cross section view of FIG. 1A taken along line 1B from FIG. 1A.
Figure 1D:
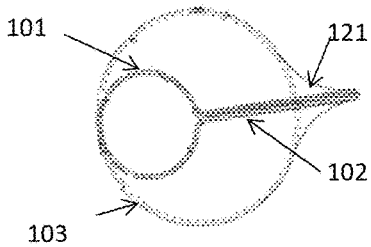
FIG. 1D is a view of the heat exchange tube looking into the tube along line 1D in FIG. 1A.

FIG. 1B is a cross section taken along line 1B from FIG. 1A and illustrates the cross section of the standard diameter section 103. The standard diameter section 103 has a standard diameter 107 and a standard circumference 108. "Standard," as used herein, refers to the starting or original shape of the tube prior to any modifications, such as crimping, which results in a reduced diameter section 101. The standard measurement, such as the standard diameter or standard circumference, can also be measured as the largest one found in the HX tube. FIG. 1C is a cross section taken along line 1C from FIG. 1A and illustrates a cross section of the reduced diameter section 101 comprising an integral flattened ridge 102 which extends outwards from the reduced diameter section 101. The reduced diameter section 101 comprises a reduced diameter 109 and a reduced circumference 120. FIG. 1D is a view looking into the HX tube 100 along line 1D of FIG. 1A. Within FIG. 1D all of the lines are illustrated such that the standard diameter section 103, the reduced diameter section 101, the integral flattened ridge 102, and transition 121 between the reduced diameter section 101 and the standard diameter section 103 can all be seen relative to each other within FIG. 1D. The transition 121 comprises a sloped portion of the HX tube between the reduced diameter section 101 and the standard diameter section 103.

Figure 2:
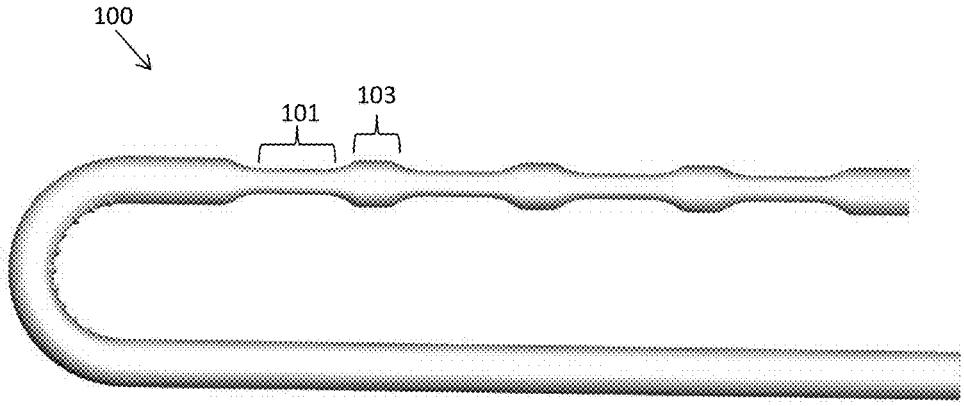
FIG. 2 is a view of the example heat exchange tube of FIG. 1A taken from the side opposite to the side shown in FIG. 1A.
Figure 3:
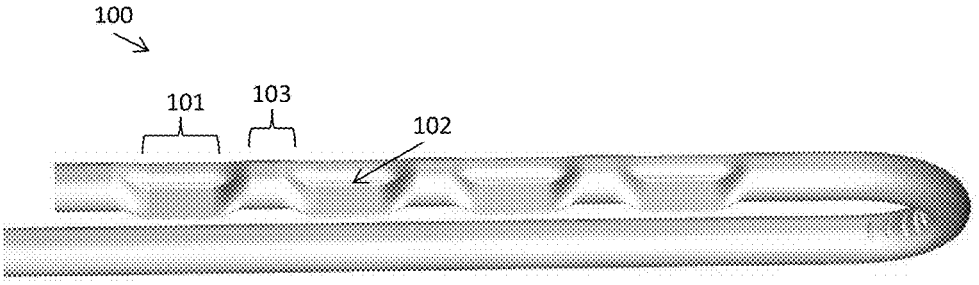
FIG. 3 is a view of the example heat exchange tube of FIG. 1A taken from the top.

FIG. 2 illustrates a view of the HX tube 100 of FIG. 1A from the side opposite to the side shown in FIG. 1A. The reduced diameter section 101 is seen interspersed with the standard diameter sections 103. FIG. 3 is a view of the HX tube 100 of FIG. 1A looking down onto the integral flattened ridge 102.

Figure 4:
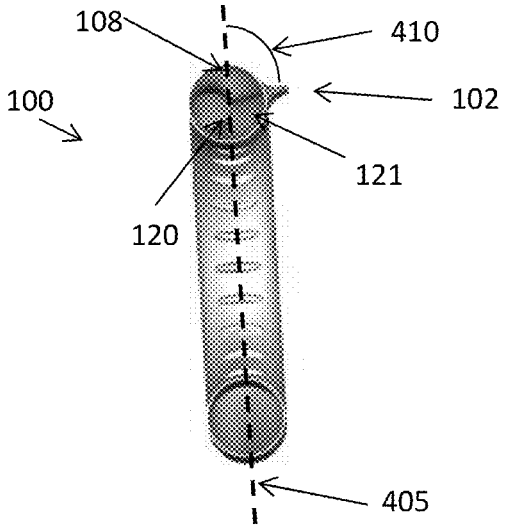
FIG. 4 is a view of the example heat exchange tube of FIG. 1A taken from the front, looking directly into upper and lower sections.

FIG. 4 is a view of the HX tube of FIG. 1A looking directly looking into the ends of the HX tube 100. The reduced circumference 120 of the reduced diameter section 101 can be seen within the HX tube 100 with the integral flattened ridge 102 extending past the standard circumference 108 of the HX tube 100. The inner surface of the transition 121 from the standard diameter section 103 to the reduced diameter section 101 is also visible in FIG. 4.

Figure 6:
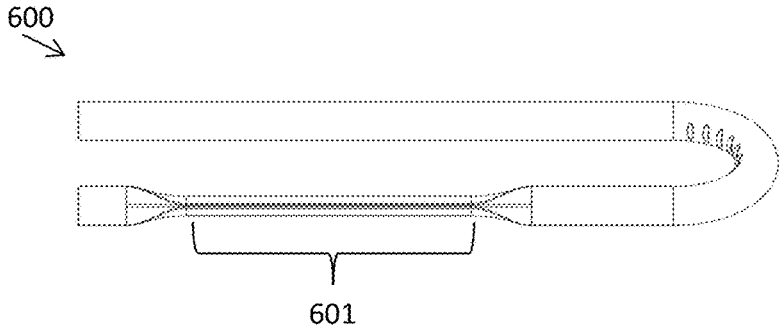
FIG. 6 is another example of a heat exchange tube comprising only one reduced diameter portion with flattened ridge

FIG. 6 is another example of a HX tube 600 comprising only one reduced diameter section with an integral flattened ridge 601.

In some embodiments, the HX tubes do not include a bent section and are straight along their entire length. In other embodiments, the HX tubes can comprise one or more bent sections. In some additional embodiments, the one or more bent sections within the HX tube is bent by about 180 degrees or another angle to suit a particular application.

The HX tubes of the disclosure can comprise one or more reduced diameter sections. For example, the HX tube could comprise between 1-20 reduced diameter sections such as 1, 2, 3, 4, 5, 6, 7, 8, 9, 10, 11, 12, 13, 14, 15 or so forth reduced diameter sections. If the HX tube is bent, the reduced diameter sections could be placed on any of the straight sections within the HX tube. The reduced diameter sections could be placed only on one of the straight portions, as shown within FIG. 1A, or the reduced diameter sections could be placed in more than one of the straight sections, for example both the upper and the lower straight sections.

If more than one reduced diameter section is included in the HX tube, in some embodiments the length of the reduced diameter sections are about equal to each other. In other embodiments, one or more of the lengths of the reduced diameter sections can be different from each other. In some embodiments, the lengths of the standard diameter sections that occur between the reduced diameter sections are about equal to each other. In other embodiments, one or more of the lengths of the standard diameter sections that occur between the reduced diameter sections could be different. In some embodiments, the reduced diameter sections are spaced away from any bent section within the HX tube.

Figure 5:
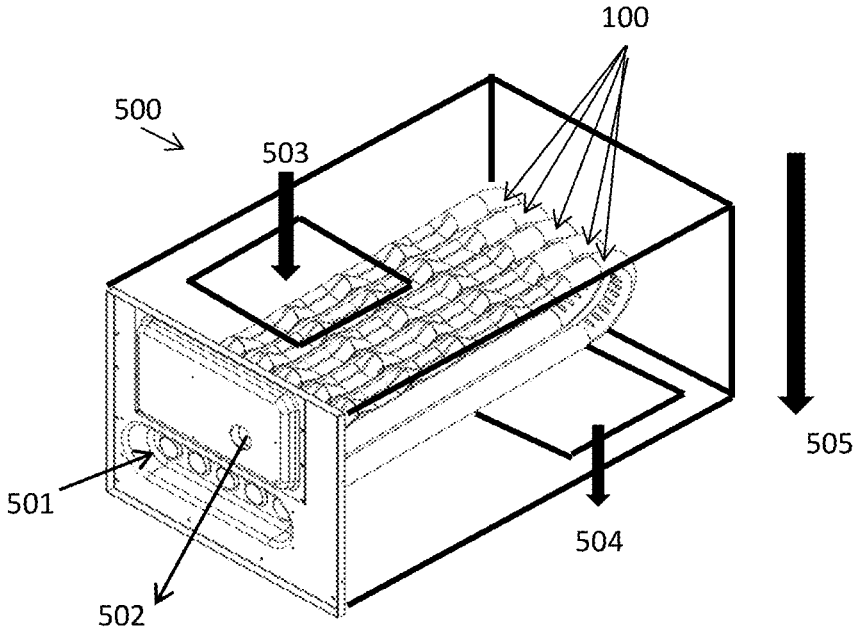
FIG. 5 is an example heat exchanger comprising five of the example heat exchange tubes shown in FIG. 1A.

In the example embodiment illustrated in FIGS. 1A-5, the HX tube includes a bend such that the upper straight section 104 and the lower straight section 105 define a reference plane 405 (shown in FIG. 4). In some embodiments, the HX tube may include more than one bend (not shown). In the example embodiment of FIGS. 1A-5, the integral flattened ridges 102 are angled slightly upward such that they form an angle 410 of 85 degrees from the reference plane 405. The angle 410 at which the integral flattened ridges 102 are positioned affects the flow of air over the outside of the HX tube. In alternate embodiments, the angle 410 at which the integral flattened ridges 102 are positioned can be adjusted to other angles for different applications. For example, the integral flattened ridge may extend at an angle between 0 degrees and 180 degrees from the reference plane 405. For example, the flattened ridge may extend at between 0-30°, 15-45°, 30-60°, 45-75°, 60-90°, 75-105°, 90-120°, 105-135°, 120-150°, 135-165°, or 150-180° from the reference plane 405. In some embodiments, the integral flattened ridge may extend at an angle between −90 to 90 degrees from the reference plane 405. For example, the flattened ridge may extend at between −90 to −30°, −75 to −45°, −60 to −30°, −45 to −15°, −30 to 0°, −15 to 15°, 0 to 30°, 15 to 45°, 30 to 60°, 45 to 75°, 30 to 60°, 45 to 75°, 60-70°. In some examples, one or more integral flattened ridge in one HX tube can be at a different angle than one or more flattened ridge in another HX tube within the heat exchanger. In an example, one or more integral flattened ridge may be at a different angle to another integral flattened ridge within the same tube. In the example embodiment illustrated in FIGS. 1A-5, the reference plane 405 coincides with the general direction of air flow 505 through the heat exchanger 505 (as illustrated in FIG. 5). Although the flow of air around HX tubes will not be uniform, it should be understood that the general direction of air flow through the heat exchanger is shown by 505 in FIG. 5.

The reduced diameter sections within the HX tube of the disclosure can have different diameters and ratios of diameters with relation to the standard diameter; however, the reduced diameter section is always smaller in diameter than the standard diameter section. In specific embodiments, the reduced diameter section has a diameter that is less than about two thirds the largest diameter of the heat exchange tube. In specific embodiments, the reduced diameter section has a diameter that is less than about half of the largest diameter of the heat exchange tube.

In embodiments of the disclosure, the integral flattened ridge extends past the largest diameter of the heat exchange tube. For example, the integral flattened ridge could extend past the largest diameter of the HX tube by at least 5, 10, 15, or 20 percent of the largest diameter of the standard tube. In some embodiments, one side of the integral flattened ridge is not pressed against the other side of the flattened ridge, and fluid is able to move within the integral flattened ridge portion of the reduce diameter section.

In some embodiments of the disclosure, the standard shape of the HX tube before crimping is not cylindrical. For example, the HX tube can be oval, or rectangular. In this case, the standard diameter is the largest width of the tube. In some embodiments of the disclosure, the reduced diameter section is not cylindrical, for example, the reduced diameter section could be oval or rectangular. In specific embodiments, the shape of the standard portion of the HX tube is the same as the reduced section. In other embodiments, the shape of the standard section of the HX tube is different from the shape of the reduced section. In some embodiments, the HX tube could have reduced sections with different shapes from other reduced diameter sections.

As shown below, HX tubes of the disclosure result in increased efficiency and improved heat transfer. For example, tests have shown that example HX tubes comprising reduced diameter sections with integral flattened ridges can result in more than an 18% improvement in efficiency (table 1). The reduced diameter sections can create additional turbulence in the flow of the working fluid passing through the HX tube while also providing for a larger surface area, resulting in increased heat transfer efficiencies.

TABLE 1

Heat-transfer efficiency across tubes of same length and diameter but different configurations at 25000 Btu/hr heat input rate per tube with the assumption of constant outside heat-transfer coefficient across the tube length.

| Configuration | Efficiency % |
|---|---|
| No reduced cross-sections on a tube | 55 |
| 4 reduced cross-sections on a tube | 73 |
| 5 reduced cross-sections on a tube | 74 |

FIG. 5 illustrates the HX tubes 100 of FIG. 1A comprising reduced cross section portions 101 with integral flattened ridges 102 within a heat exchanger 500. The heat exchanger 500 takes in a working fluid, such as gases from a combustion process, through an intake 501 from a burner assembly (not shown). The working fluid flows into the HX tubes 100, through additional components such as another optional HX tube configured as a third and a fourth pass (not shown), and out through an exhaust 502. Additional HX tubes, such as a third and fourth pass may also include reduced diameter sections with integral flattened ridges. The fluid to which heat is transferred to from the HX tubes enters the heat exchanger 500 through an intake 503, usually through the use of a circulation blower fan (not shown) and exits the heat exchanger at an exit 504 which usually leads to duct work. The fluid to be heated flows across the outer surfaces of the HX tubes 100. In this way, when the hot gases (from the combustion process) travel down the HX tubes 100, some of the heat from the combustion is transferred to the walls of the HX tubes 100, and as the outside fluid comes into contact with the outer surface of the walls of the HX tubes 100, some of the heat captured by the walls of the HX tubes 100 from the working fluid is transferred to the fluid from heat exchanger 500 by multiples ways such as convection and radiation. The fluid heated by the HX tubes can then be used for one or more other processes, such as space heating.

Since HX tubes with an integral flattened ridge have an extended exterior surface area, like a heat sink, as compared with a dimple like deformation that is created by pressing the HX tube surface towards the centerline of the tube, fluids (e.g., the air to be heated) that flow around the HX tubes have more time in contact with the tube, thereby resulting in increased efficiency of the heat exchanger (Table 1). Further, adjusting the angle of the integral flattened ridge allows airflow to be better controlled within the interior of the heat exchanger 500, providing improved control on regulating the pressure drop for the air passing over the outside of the HX tubes within the heat exchanger. When tested, the pressure drop of a conventional gas heat exchanger with 2.25" HX tube was shown to be 0.27 W.C. vs. 0.21 W.C. using a HX tubes of the disclosure with a standard diameter of 1.75" and 5 reduced cross-section areas comprising integral flattened ridges at 68 degrees to the outside flow direction 505 (table 2).

TABLE 2

Pressure drop across the heat exchanger furnace at 1600 CFM of circulation-air. Wherever applicable, there are five HX tubes inside the heat exchanger along with a secondary HX tube of 2" diameter.

| Configuration | Pressure-drop (in W.C.) |
|---|---|
| Heat exchanger cabinet without any HX tubes | 0.04 |
| Round primary HX tubes with 1.75" dia. | 0.12 |
| Round primary HX tubes with 2" dia. | 0.17 |
| Round primary HX tubes with 1.75" dia and with 5 flattened ridges at 68 degrees to the flow direction 505 | 0.21 |
| Round primary HX tubes with 1.75" dia and with 5 flattened ridges at 90 degrees to the flow direction 505 | 0.25 |
| Round primary HX tubes with 2.25" dia. | 0.27 |

By carefully engineering the various characteristics of the reduced diameter sections in an example HX tube and engineering the positioning of the tubes and the integral flattened ridges, the flow of working fluid inside the HX tubes, and outer fluid around and in between the HX tubes can become more efficient, providing a number of benefits, including but not limited to lower blower watts, lower fuel consumption, lower costs, and less waste. Example HX tubes of the disclosure can also create a significantly reduced pressure drop in the heat exchanger. Example HX tubes can further allow a heat exchanger to comply with any applicable standards and/or regulations. Example embodiments can be mass produced or made as a custom order.

Accordingly, many modifications and other embodiments set forth herein will come to mind to one skilled in the art to which example HX tubes pertain having the benefit of the teachings presented in the foregoing descriptions and the associated drawings. Therefore, it is to be understood that example HX tubes are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A heat exchange tube comprising:

a standard diameter section comprising a largest diameter; and at least one reduced diameter section comprising a reduced circumference and an integral flattened ridge, the integral flattened ridge extending outwardly from the reduced circumference and past the largest diameter of the heat exchange tube.

2. The heat exchange tube of claim 1, additionally comprising an upper straight section, a lower straight section, and a bent section connecting the upper straight section with the lower straight section, wherein the upper straight section and the lower straight section are about parallel to each other.

3. The heat exchange tube of claim 1, wherein the integral flattened ridge extends along a portion of a length of the at least one reduced diameter section.

4. The heat exchange tube of claim 1, wherein the heat exchange tube is straight.

5. The heat exchange tube of claim 1, wherein the heat exchange tube comprises between 2-8 reduced diameter sections.

6. The heat exchange tube of claim 5, wherein a length of one of the reduced diameter sections is different from a length of at least one other reduced diameter section.

7. The heat exchange tube of claim 5, wherein the heat exchange tube comprises 5 reduced diameter sections.

8. The heat exchange tube of claim 1, wherein the at least one reduced diameter section has a diameter that is about less than two thirds the largest diameter of the heat exchange tube.

9. The heat exchange tube of claim 8, wherein the at least one reduced diameter section has a diameter that is about half the diameter of the largest diameter of the heat exchange tube.

10. The heat exchange tube of claim 1, wherein the integral flattened ridge extends past the largest diameter of the heat exchange tube by at least 20 percent of the largest diameter of the heat exchange tube.

11. The heat exchange tube of claim 1, wherein a working fluid is able to move within the flattened ridge.

12. The heat exchange tube of claim 2, wherein the integral flattened ridge extends at an angle of between −90 degrees and 90 degrees from a direction of air flow over the heat exchange tube.

13. A furnace comprising:

a heat exchanger comprising a plurality of heat exchange tubes, wherein the plurality of heat exchange tubes are configured to receive a working fluid from a burner assembly, and wherein each heat exchange tube comprises:

a standard diameter section comprising a largest diameter, and a reduced diameter section comprising a reduced circumference and an integral flattened ridge, the integral flattened ridge extending outwardly from the reduced circumference and past the largest diameter of the heat exchange tube;

an exhaust configured to receive the working fluid from the plurality of heat exchange tubes; and a circulation blower fan configured to move air over an outside of the plurality of heat exchange tubes and into a supply duct.

14. The furnace of claim 13, wherein the integral flattened ridge extends at an angle of between −90 degrees and 90 degrees from a direction of air flow through the heat exchanger.

15. The furnace of claim 13, wherein the heat exchanger comprises between 2-20 heat exchange tubes.

16. The furnace of claim 14, wherein each heat exchange tube comprises between 2-8 reduced diameter sections with integral flattened ridges.

17. The furnace of claim 13, wherein the integral flattened ridge extends at an angle of between −90 to −60 or 60 to 90 degrees from a direction of air flow through the heat exchanger.

18. The furnace of claim 13, wherein each heat exchange tube additionally comprises an upper straight section, a lower straight section, and a bent section connecting the upper straight section with the lower straight section, wherein the upper straight section and the lower straight section are about parallel to each other.

19. The furnace of claim 18, wherein the upper straight section and the lower straight section define a reference plane that forms an angle between −90° to 90° from a direction of air flow through the heat exchanger.

* * * * *